US011161666B2

(12) United States Patent
Fenech et al.

(10) Patent No.: US 11,161,666 B2
(45) Date of Patent: Nov. 2, 2021

(54) PACKAGE FOR CONSUMABLE PRODUCTS

(71) Applicant: INTERCONTINENTAL GREAT BRANDS LLC, East Hanover, NJ (US)

(72) Inventors: Louis Fenech, East Hanover, NJ (US); Jun Park, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 16/624,979

(22) PCT Filed: Jun. 21, 2018

(86) PCT No.: PCT/US2018/038753
§ 371 (c)(1),
(2) Date: Dec. 20, 2019

(87) PCT Pub. No.: WO2019/013945
PCT Pub. Date: Jan. 17, 2019

(65) Prior Publication Data

US 2020/0140174 A1 May 7, 2020

Related U.S. Application Data

(60) Provisional application No. 62/531,946, filed on Jul. 13, 2017.

(51) Int. Cl.
*B65D 77/00* (2006.01)
*B65D 75/04* (2006.01)
(Continued)

(52) U.S. Cl.
CPC ..... *B65D 77/003* (2013.01); *B65D 75/04* (2013.01); *B65D 75/585* (2013.01); *B65D 77/24* (2013.01); *B65D 85/60* (2013.01)

(58) Field of Classification Search
CPC .... B65D 77/003; B65D 75/04; B65D 75/585; B65D 77/24; B65D 85/60
(Continued)

(56) References Cited

U.S. PATENT DOCUMENTS 2,197,388 A 4/1940 Towers
2,514,255 A * 7/1950 Piazze
(Continued)

FOREIGN PATENT DOCUMENTS

CN 101037158 A 9/2007
EP 1547936 A1 * 6/2005 ..... B65D 75/5833
(Continued)

OTHER PUBLICATIONS

Machine translation of EP-1547936-A1.*
Machine translation of JPH10147365A.*

*Primary Examiner* — Jes F Pascua
(74) *Attorney, Agent, or Firm* — Hoffmann & Baron, LLP

(57) ABSTRACT

In the present invention, a package for supporting at least one consumable product is provided. The package includes a support member for supporting the at least one consumable product, a flexible package for enclosing the support member and the at least one product, and a closure mechanism configured to transit the package between open and closed positions. The flexible package has a line of weakness and a flap defined and positioned near an area formed by the line of weakness. When the flap is pulled, it ruptures the line of weakness and creates an opening to allow access to the at least one consumable product.

22 Claims, 7 Drawing Sheets

(51) Int. Cl.
*B65D 75/58* (2006.01)
*B65D 77/24* (2006.01)
*B65D 85/60* (2006.01)

(58) Field of Classification Search
USPC ..... 383/203
See application file for complete search history.

(56) References Cited

U.S. PATENT DOCUMENTS

| | | | | |
|---|---|---|---|---|
| 3,017,990 | A | 1/1962 | Singerman | |
| 3,313,473 | A * | 4/1967 | Witters | |
| 6,200,029 | B1 * | 3/2001 | Bonta | |
| 6,929,400 | B2 * | 8/2005 | Razeti et al. | |
| 2011/0303574 | A1 * | 12/2011 | Aldridge | B65D 75/5833 206/470 |
| 2013/0004626 | A1 * | 1/2013 | Renders | B65D 33/02 426/121 |
| 2015/0225158 | A1 * | 8/2015 | Lyzenga | B65D 75/58 206/476 |
| 2017/0267428 | A1 * | 9/2017 | Lyzenga | B65B 11/48 |

FOREIGN PATENT DOCUMENTS

| | | | | |
|---|---|---|---|---|
| FR | 1281963 | A * | 1/1962 | A24F 23/02 |
| JP | 50-35687 | | 7/1948 | |
| JP | 45-18155 | | 7/1970 | |
| JP | 10147365 | A * | 6/1998 | |
| WO | 2012/037473 | A2 | 3/2012 | |
| WO | 2012/057961 | A2 | 5/2012 | |
| WO | 2016/087826 | A1 | 6/2016 | |

* cited by examiner

PACKAGE FOR CONSUMABLE PRODUCTS

CROSS REFERENCE TO RELATED APPLICATIONS

This application is the National Stage of International Application No. PCT/US2018/038753, which designates the U.S., filed Jun. 21, 2018, which claims the benefit of U.S. Provisional Patent Application No. 62/531,946 filed Jul. 13, 2017, the contents of all of which are incorporated herein by reference in its entirety.

FIELD OF THE INVENTION

The present invention relates to consumable products packages, and more particularly, to hermetically sealed consumable products packages configured to contain and support consumable products disposed therewithin.

BACKGROUND OF THE INVENTION

Certain consumable products, such as gum slabs or sticks, are normally accommodated in a packaging device to protect the products and to provide an ease of use for consumers. Currently, there are various packaging devices that are designed and configured to accommodate and dispense the consumable products. Each of these packaging devices normally includes an end seal which may be rupture to open and access the products contained therewithin. In addition, most of these packaging devices generally employ a closure mechanism such that a consumer can dispense the products therefrom and close the package device repeatedly.

While various packaging devices for consumable products are available currently in the marketplace, it is desirable to provide a packaging device for consumable products such as gum slabs with further improvements.

SUMMARY OF THE INVENTION

According to an embodiment of the present invention, a package for supporting at least one consumable product includes a support member for supporting the at least one consumable product, a flexible package for enclosing the support member and the at least one product, and a closure mechanism configured to transit the package between open and closed positions. The flexible package has a line of weakness and a flap defined and positioned near an area formed by the line of weakness. When the flap is pulled, it ruptures the line of weakness and creates an opening to allow access to the at least one consumable product.

These and other aspects of the present invention will be better understood in view of the drawings and following detailed description.

DETAILED DESCRIPTION OF PREFERRED EMBODIMENTS

Figure 1:
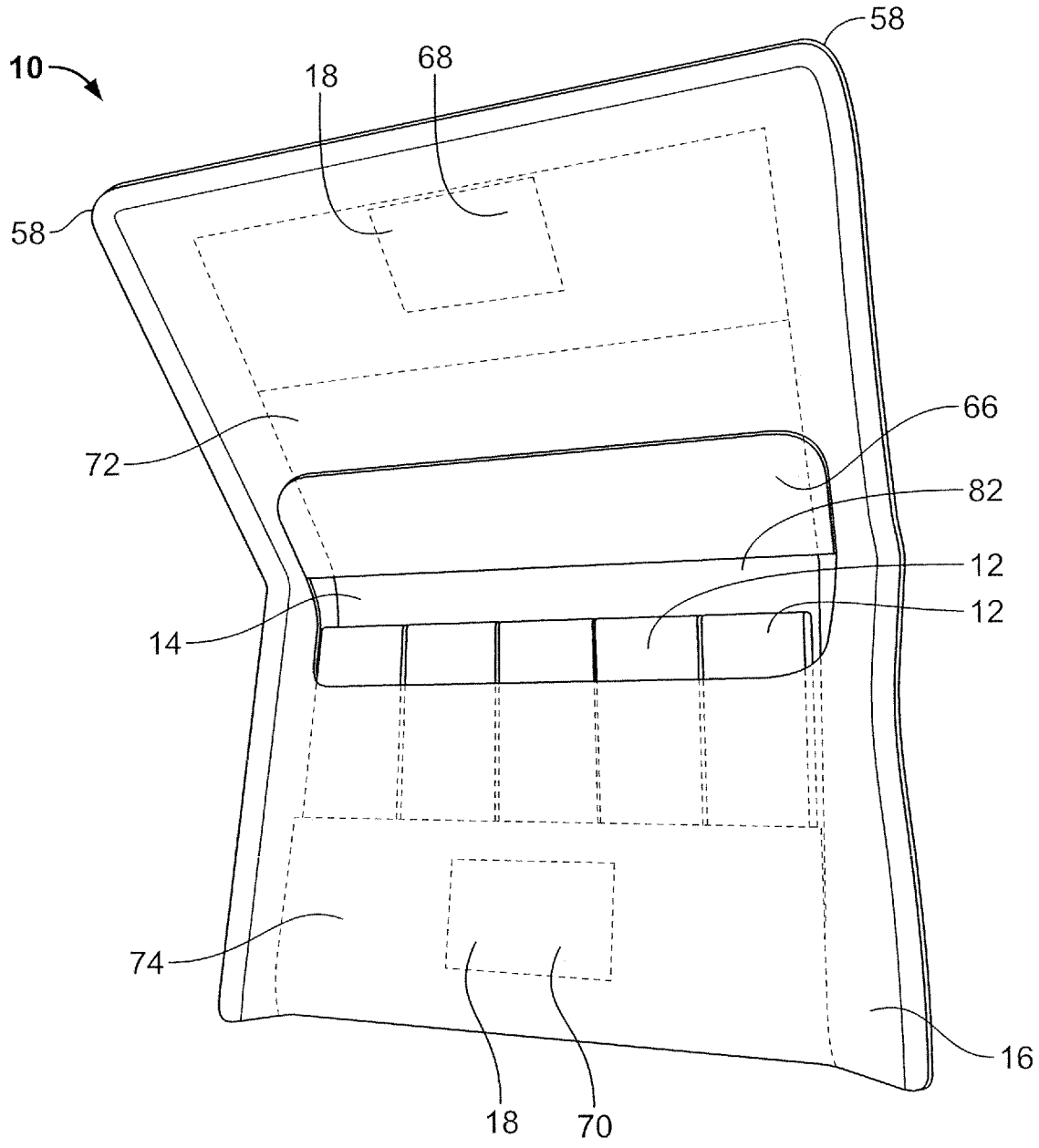
FIG. 1 is a perspective view of a consumable product package, according to an embodiment of the present invention, in an open position.
Figure 2:
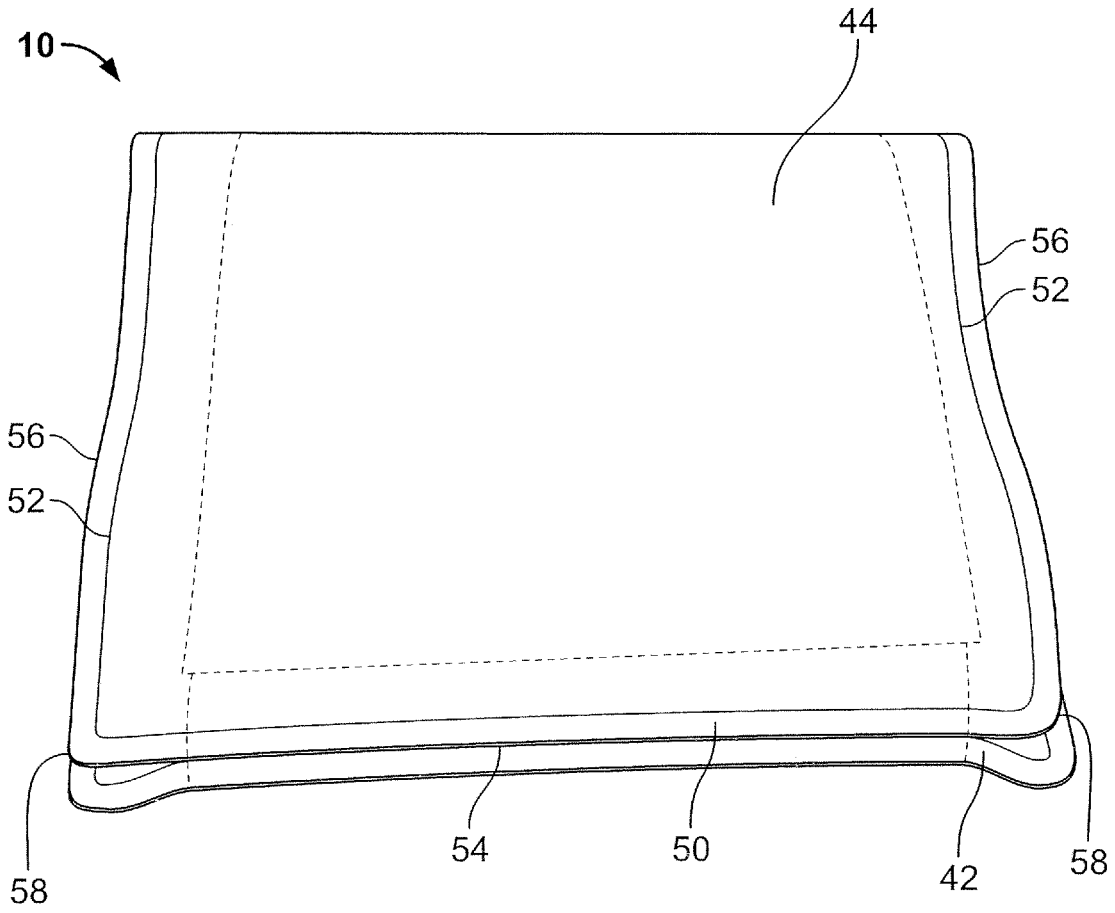
FIG. 2 is a perspective view of the consumable product package in FIG. 1, in a closed position.

According to an embodiment of the present invention, referring to FIGS. 1 and 2, there is shown a consumable product package 10 having a plurality of consumable products 12 contained therewithin. While gum slabs, typically elongate rectangular shaped and individually wrapped, are shown (FIG. 1) in the preferred embodiment of the present invention, other suitable elongate consumable products may be supported by the package 10.

The package 10 includes a support member 14 for supporting and containing the consumable products 12, a flexible package 16 for enclosing the support member 14 and the products 12 contained therewithin, and a closure mechanism 18 configured to transit the package 10 between open, shown in FIG. 1, and closed, shown in FIG. 2, positions, as will be described in greater detail below.

Directional terms, such as top and bottom are referenced to an orientation in which the package 10 is placed on a flat surface in the open position with the consumable productions contained in a bottom half of the package 10, as shown in FIG. 1. However, the present invention is not thereby limited to use in any particular orientation.

Figure 3:
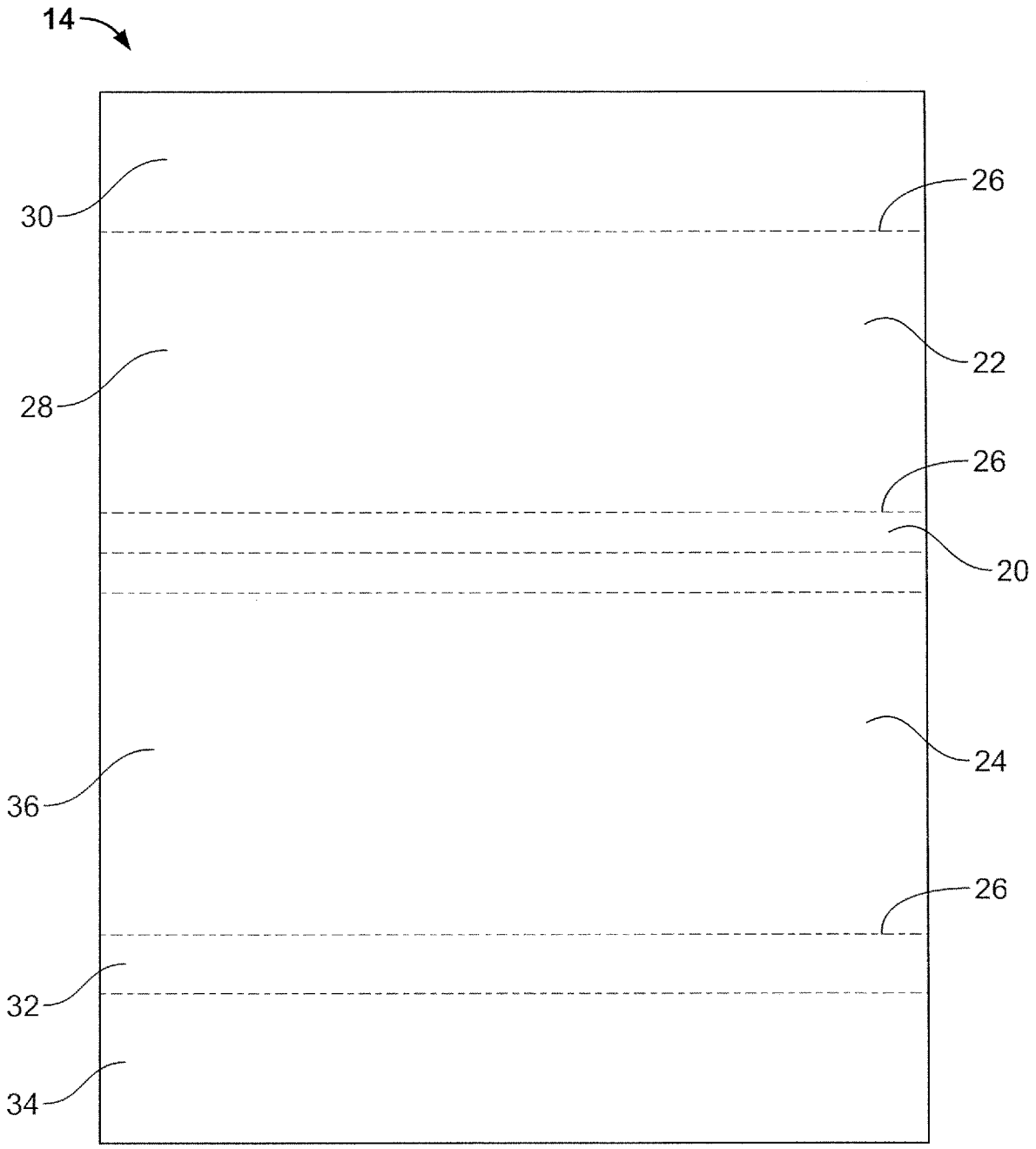
FIG. 3 is a perspective view of the support member of the consumable product package in FIG. 1.

Referring to FIG. 3, there is shown the support member 14 configured to provide structure to the package 10. The support member 14 is preferably planar rectangular shaped and has a connecting member 20, top and bottom members 22, 24 connected and separated by the connecting member 20, and a plurality of creases 26. The top member 22 of the support member 14 includes a main portion 28 and a top portion 30 which is laid over the front portion 34 in the direction of Arrow A (FIG. 4) and attaches thereto during assembly. The bottom member 24 of the support member 14 includes a bottom connecting portion 32 and front and rear portions 34, 36 connected and separated by the bottom connecting portion 32. The plurality of creases 26 delineate a boundary between each member and each portion. In addition, the plurality of creases 26 allow folding of portions of the support member 14 and, together with the closure mechanism 18, allow the package 10 to transit between open and closed positions, as will be described in greater detail below.

Figure 4:
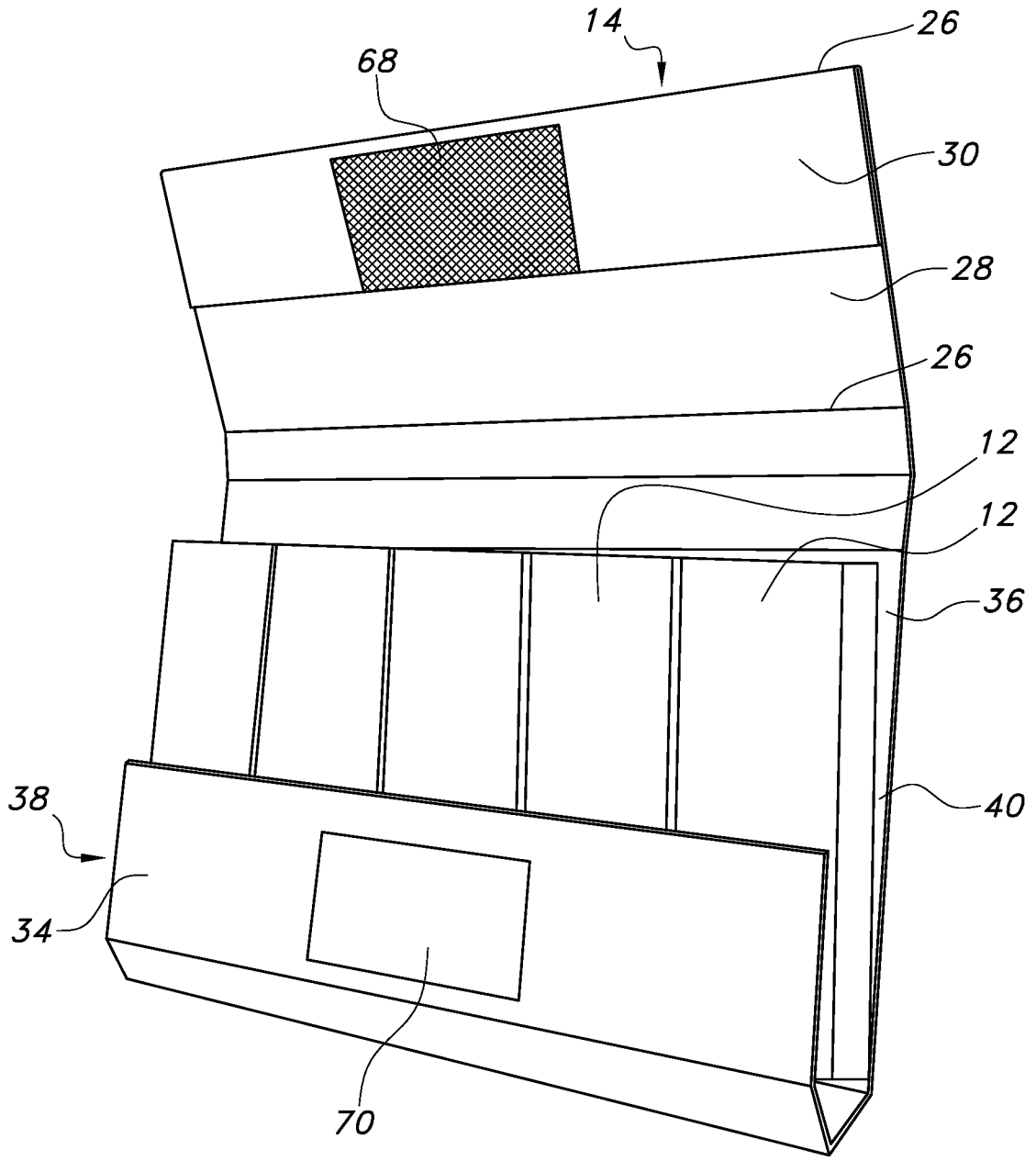
FIG. 4 is a perspective view of the support member of the consumable product package in FIG. 1, with the support member folded to form a support member pouch with the consumable products disposed therewithin.

Referring to FIGS. 3 and 4, the support member 14 is configured to be folded along the plurality of creases 26 to form a support member pouch 38 during assembly for containing and supporting the consumable products 12 therewithin. Specifically, the front portion 34 of the bottom member 24 of the support member 14 is folded such that the folded front portion 34 is substantially parallel with the rear portion 36 of the bottom member 24, defining a product retaining space 40 therebetween, as shown in FIG. 4. The support member pouch 38 is configured and dimensioned so that the elongate consumable products 12 such as the gum slabs could be closely accommodated in a side-by-side or other suitable orientation within the product retaining space 40. In addition, the front portion 34 of the bottom member 24 of the support member 14 extends partially upwards, approximately to a half length of the rear portion 36, to provide access and to remove the consumable products 12 from the support member 14. As shown in FIG. 4, the support member pouch 38 has no sidewalls.

Figure 5:
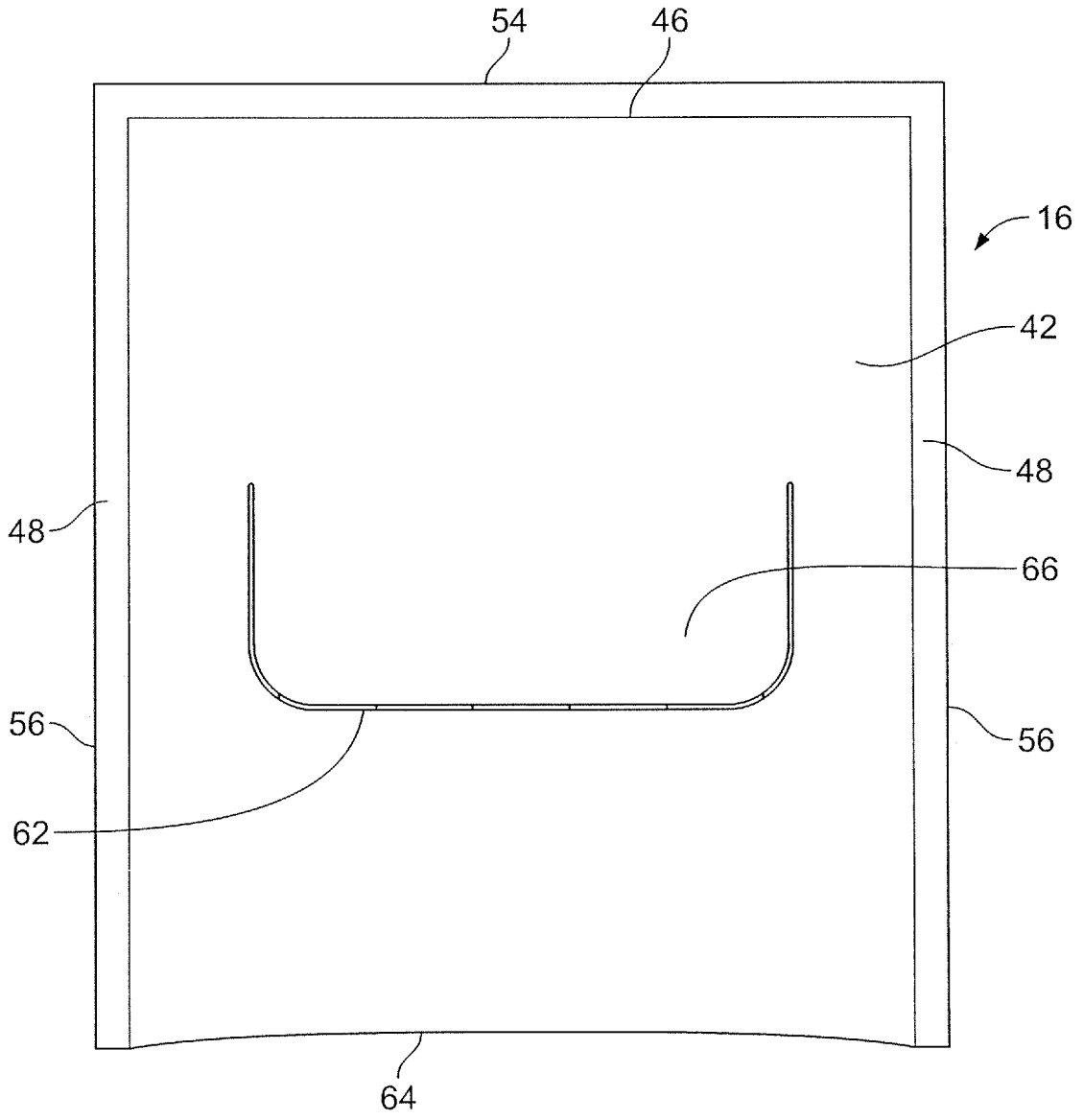
FIG. 5 is a perspective view of the flexible package of the consumable product package, without an opening defined thereon.

Referring to FIGS. 1, 2, and 5, the flexible package 16 is configured to completely surround the support member 14 and consumable products 12 contained therewithin. The flexible package 16 includes inner and outer films 42, 44 that define inner and outer sides of the flexible package 16, respectively. Top 46 and opposing side edge portions 48 of the inner film 42 are hermetically sealed together with top 50 and opposing side edge portions 52 of the outer film 44, respectively, to form top 54 and opposed side hermetically sealed edges 56 with rounded corners 58 such that the inner and outer films 42, 44 define an interior space. The hermetically sealed flexible package 16 provides an environmental barrier for the consumable products 12 contained therewithin such that it protects and improves a shelf life of the consumable products 12. In addition, the rounded corners 58 allow the package 10 to be carried comfortably within a pocket. The interior space of the flexible package 16 and the support member 14 are dimensioned such that the support member 14 could be movably contained and closely accommodated within the interior space of the flexible package 16, as shown in FIG. 1.

Referring again to FIG. 5, the flexible package 16 further includes a line of weakness 62, which is preferably formed by perforations. The line of weakness 62 is preferably arcuate and is defined on the inner film 42 of the flexible package 16. When the package 10 is in the open position, the line of weakness 62 is positioned closer to a bottom edge 64 than the top edge 54 of the flexible package 16, with a convex side of the arcuate line of weakness 62 facing the bottom edge 64 of the flexible package 16. In addition, a flap 66 is defined and positioned near an area formed by the line of weakness 62.

In a preferred embodiment, magnets are employed to provide the closure mechanism 18 of the package 10. Specifically, first and second magnets 68, 70 are applied and attached to the front portion 34 of the bottom member 24 and the top portion 30 of the top member 22 of the support member 14, respectively, as shown in FIGS. 1 and 4. When the package 10 transitions from the open position to the closed position, top and bottom sections 72, 74 of the package 10 are folded along the plurality of creases 26 and are substantially parallel to each other such that the first and second magnets 68, 70 are aligned, engaged, and magnetically adhered to each other with the inner film 42 of the flexible package 16 being in between the first and second magnets 68, 70, as shown in FIG. 2.

Figure 6:
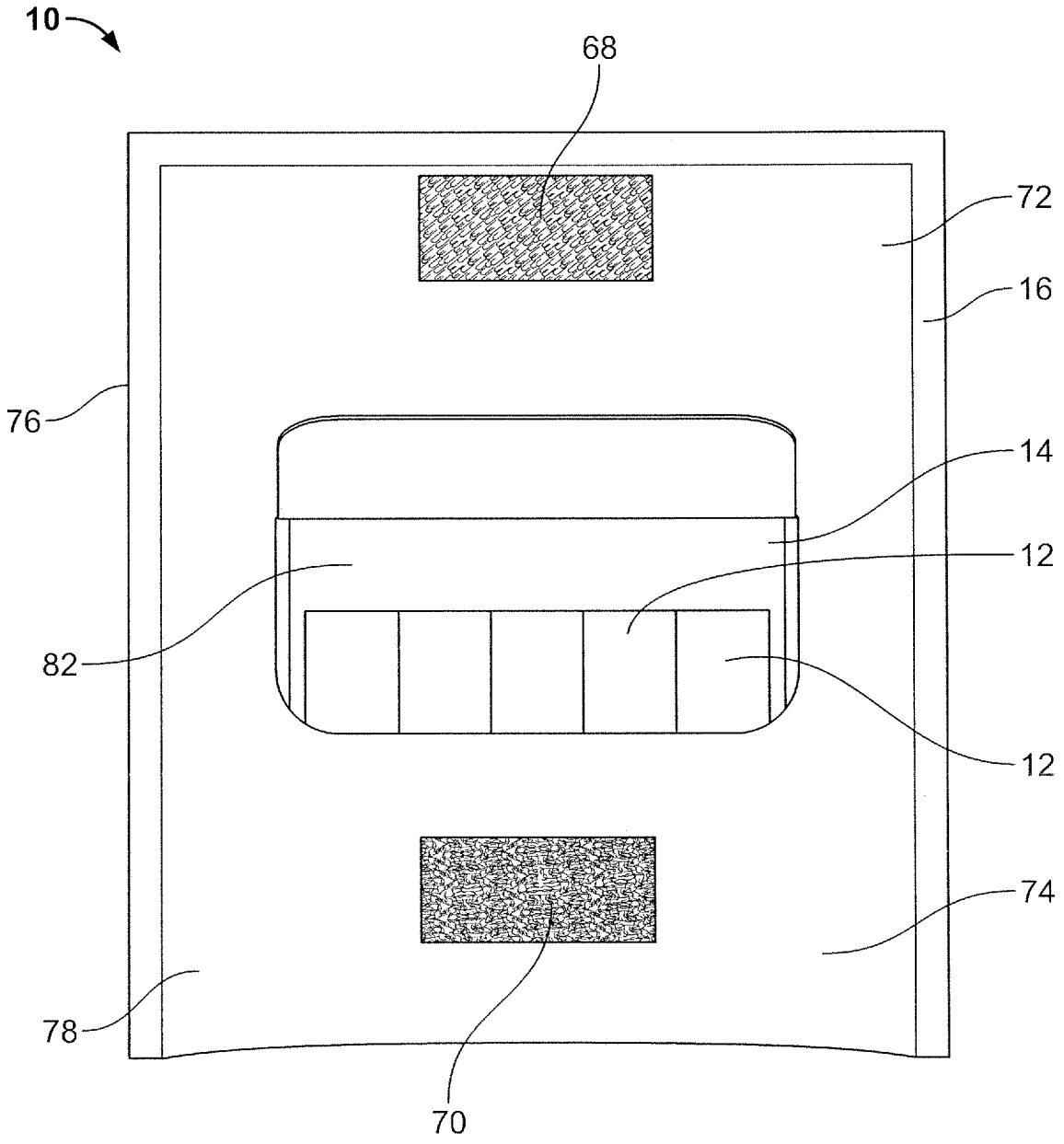
FIG. 6 is a perspective view of the consumable product package, with magnets employed as a closure mechanism on the flexible package.

Alternatively, the first and second magnets 68, 70 may be attached to or printed on top and bottom sections 76, 78 of the inner film 42 of the flexible package 16, respectively, as shown in FIG. 6. When the package 10 is in the closed position, the first and second magnets 68, 70 are directly engaged and magnetically adhered to each other, without any intervening structures therebetween. To transit the package 10 back to the open position, the top and bottom sections 72, 74 of the package 10 are simply pulled away from each other with adequate force to disengage the magnets 68, 70.

Figure 7:
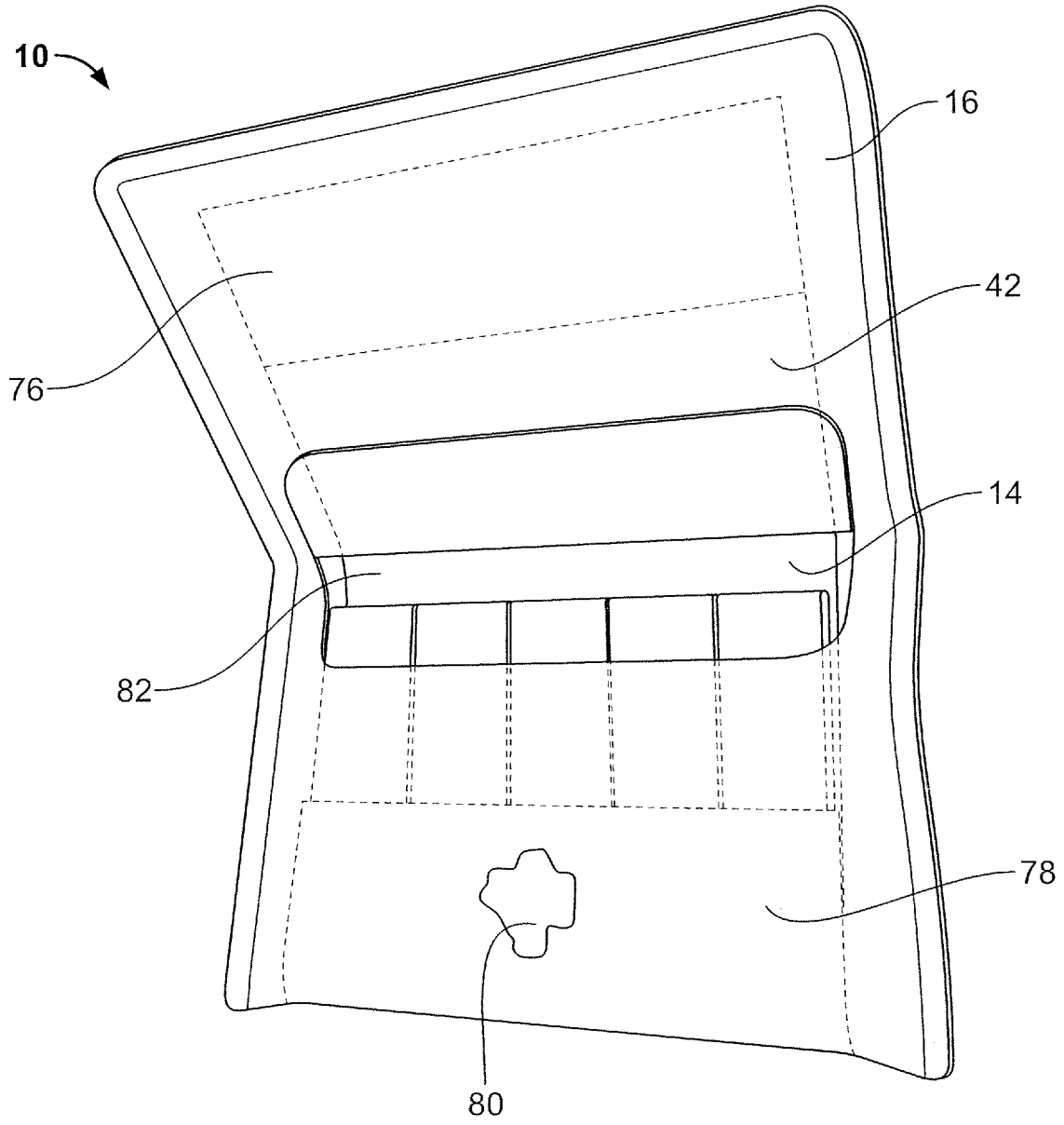
FIG. 7 is a perspective view of the consumable product package in FIG. 1, with a reclosable adhesive employed as a closure mechanism on the flexible package.

It will be appreciated that other designs and configurations could be used for the closure mechanism 18 of the package 10, as deemed suitable for given application factors. For example, in an alternate embodiment, a reclosable adhesive 80 is applied as the closure mechanism 18, as shown in FIG. 7. Specifically, the reclosable adhesive 80 is applied to the bottom section 78 of the inner film 42 of the flexible package 16 such that, when the package 10 is in the closed position, the reclosable adhesive 80 allows the top and bottom sections 76, 78 of the inner film 42 to be engaged and adhered to each other.

In yet another embodiment, hook and loop fasteners of Velcro (not shown) may be employed as the closure mechanism. Specifically, hooks and loops (not shown) are attached to the top and bottom sections 76, 78 of the inner film 42 of the flexible package 16, respectively. Similar to the magnets, when the package 10 transitions to the closed position from the open position, the top and bottom sections 72, 74 of the package 10 are folded along the plurality of creases 26 and are substantially parallel to each other such that the hooks and loops (not shown) are aligned, engaged, and attached to each other. To transit the package 10 back to the open position, the top and bottom sections 72, 74 of the package 10 are simply pulled away from each other with adequate force to disengage the hooks and loops of Velcro (not shown).

In the present invention, an attachment force of the closure mechanism 18, is stronger than the hinge memory force of the package 10. This allows the package 10 to be remained in the closed position once the closure mechanism 18 engages.

When the package 10 is assembled, initially, the package 10 is in the closed position, as shown in FIG. 2, with the flap 66 adhered to the inner film 42 of the flexible package 10. Thus, if a user desires to dispense and consume the consumable products 12 contained within the package 10, first, the package 10 needs to be opened. In the present invention, since the strength of the adhesive that attaches the flap 66 to the inner film 42 of the flexible package 16 is greater than the strength required to rupture the line of weakness 62, by simply opening the package 10 for the first time, the flap 66 ruptures the line of weakness 62 and creates an opening 82 to expose the consumable products 12 contained therewithin to allow access to the consumable products 12.

Once the line of weakness 62 is ruptured and the opening 82 is created on the flexible package 16, the package 10 may be closed with the closure mechanism 18, as described above, to prevent access to the consumable products 12 contained within the support member 14 and also to prevent the consumable products 12 being removed from the package 10 through the opening 82. The package 10 may be closed and opened as many times as the consumer desires.

The package 10 is designed and configured such that it can be run on a horizontal wrapping equipment without a major changeover to the equipment or significant additional cost per each product. This allows various sized packages to be constructed to hold different amounts of consumable products 12 therewithin, which currently existing packaging equipment and systems cannot provide.

The package 10 is made of one or more materials having suitable properties for a desired application, including strength, weight, rigidity, etc. A stiffening board, cardboard, paperboard, or plastic is generally preferred for the support member 14. The support member 14 may be formed from a single flat plastic, stiffening board, cardboard, or paperboard blank. For the flexible package 16, monoweb flexible and hermetically sealable material such as polymer laminate is generally preferred.

From the foregoing, it will be appreciated that a consumable product package according to the present invention allows consumable products to be contained therewithin, while providing an environmental barrier and a closure mechanism to improve a shelf life of the consumable products.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A package for supporting at least one consumable product comprising: a support member for supporting the at least one consumable product, the support member being planar shaped and including a connecting member, a top member, and a bottom member, the top and bottom members being connected and separated by the connecting member, said bottom member including a connecting portion, a front portion, and a rear portion, and wherein the front and rear portions are connected and separated by the bottom connecting portion which is defined by creases which allow for folding and wherein the top member includes a main portion; and wherein the top member includes a main portion and a top portion, and wherein the top portion is laid over and attached to the main portion;

a flexible package for enclosing the support member and the at least one product, the flexible package having a line of weakness and a flap defined and positioned near an area formed by the line of weakness, and, when the flap is pulled, it ruptures the line of weakness and creates an opening to allow access to the at least one consumable product; and a closure mechanism configured to transit the package between open and closed positions.

2. The package of claim 1, wherein the support member further includes a plurality of creases such that the support member could be folded along the plurality of creases to form a support member pouch for containing and retaining the at least one consumable product therewithin.

3. The package of claim 2, wherein the support member pouch has no sidewalls.

4. The package of claim 1, wherein the flexible package further includes inner and outer films with top and opposing side edge portions of the inner film being hermetically sealed together with top and opposing side edge portions of the outer film, respectively, to form top and opposed side hermetically sealed edges such that the inner and outer films define an interior space.

5. The package of claim 4, wherein the support member is configured and dimensioned to be movably contained and closely accommodated within the interior space of the flexible package.

6. The package of claim 5, wherein the closure mechanism is magnets, reclosable adhesive, or hooks and loops.

7. The package of claim 6, wherein the magnets are applied and attached to the front portion of the bottom member and the top portion of the top member of the support member, and, when the package is in the closed position, the top member of the support member lay over the front portion of the bottom member of the support member such that the magnets are aligned, engaged, and magnetically adhered to each other with the inner film of the flexible package being in between the magnets.

8. The package of claim 6, wherein the magnets are attached to top and bottom sections of the inner film of the flexible package, and, when the package is in the closed position, the top section of the flexible package lay over the bottom section of the flexible package such that the magnets are directly engaged and magnetically adhered to each other.

9. The package of claim 6, wherein the reclosable adhesive is applied to bottom section of the inner film of the flexible package, and, when the package is in the closed position, top section of the flexible package lay over the bottom section of the flexible package such that the reclosable adhesive allows the top and bottom sections of the inner film to be engaged and adhered to each other.

10. The package of claim 6, wherein the hooks and loops are attached to top and bottom sections of the inner film of the flexible package, and, when the package is in the closed position, the top section of the flexible package lay over the bottom section of the flexible package such that the hooks and loops are aligned, engaged, and attached to each other.

11. The package of claim 4, wherein the flap is attached to the inner film of the flexible package using an adhesive.

12. The package of claim 11, wherein the strength of the adhesive that attaches the flap to the inner film of the flexible package is greater than the strength required to rupture the line of weakness.

13. The package of claim 4, wherein the line of weakness is defined on the inner film of the flexible package and, when the package is in the open position, the line of weakness is positioned closer to a bottom edge than a top edge of the flexible package.

14. The package of claim 1, wherein the flexible package is polymer laminate.

15. The package of claim 1, wherein the flexible package is monoweb.

16. The package of claim 1, wherein the line of weakness is arcuate.

17. The package of claim 16, wherein, when the package is in the open position, a convex side of the arcuate line of weakness faces a bottom edge of the flexible package.

18. The package of claim 1, wherein the line of weakness is formed by perforations.

19. The package of claim 1, wherein the support member is made out of a stiffening board, cardboard, paperboard, or plastic.

20. The package of claim 1, wherein the flexible package has round corners.

21. The package of claim 1, wherein an attachment force of the closure mechanism is stronger than a hinge memory force of the package.

22. The package of claim 1, wherein the at least one consumable product is elongate.

* * * * *